US011005224B1

(12) United States Patent
Nguyen et al.

(10) Patent No.: US 11,005,224 B1
(45) Date of Patent: May 11, 2021

(54) ELECTRICAL ADAPTER WITH INTEGRAL LEVER ARMS

(71) Applicant: CORDELIA LIGHTING, INC., Rancho Dominguez, CA (US)

(72) Inventors: Huan C. Nguyen, Placentia, CA (US); Aaron O'Brien, Los Alamitos, CA (US); Lindsey Francois, Burbank, CA (US)

(73) Assignee: Cordelia Lighting, Inc., Rancho Dominguez, CA (US)

( * ) Notice: Subject to any disclaimer, the term of this patent is extended or adjusted under 35 U.S.C. 154(b) by 0 days.

(21) Appl. No.: 16/831,810

(22) Filed: Mar. 27, 2020

(51) Int. Cl.

| | |
|---|---|
| ***H01J 5/54*** | (2006.01) |
| ***H01R 33/94*** | (2006.01) |
| ***F21V 19/00*** | (2006.01) |
| ***H01R 33/945*** | (2006.01) |
| ***F21K 9/23*** | (2016.01) |
| ***H01R 13/24*** | (2006.01) |
| ***F21V 21/02*** | (2006.01) |
| ***H01R 33/22*** | (2006.01) |
| *F21Y 115/10* | (2016.01) |
| *F21Y 105/00* | (2016.01) |

(52) U.S. Cl.
CPC ..... *H01R 33/94* (2013.01); *F21K 9/23* (2016.08); *F21V 19/006* (2013.01); *F21V 21/02* (2013.01); *H01R 13/245* (2013.01); *H01R 33/22* (2013.01); *H01R 33/945* (2013.01); *F21Y 2105/00* (2013.01); *F21Y 2115/10* (2016.08)

(58) Field of Classification Search
CPC ..... H01R 33/09; H01R 33/22; H01R 4/2433; F21S 4/001; H01K 1/46
USPC ..... 439/617, 575, 602, 339, 417; 362/226, 362/377, 391, 806
See application file for complete search history.

(56) References Cited

U.S. PATENT DOCUMENTS

| | | | | |
|---|---|---|---|---|
| 2,455,829 | A * | 12/1948 | Thomas | H01K 1/46 439/617 |
| 5,989,070 | A * | 11/1999 | Al-Turki | F21V 19/006 439/638 |
| 6,162,096 | A * | 12/2000 | Klaus | F21S 8/02 439/226 |
| 7,407,418 | B1 * | 8/2008 | Harlan | F21V 19/00 439/641 |
| 7,413,456 | B1 * | 8/2008 | DiFusco | H01R 33/22 439/253 |
| 8,708,525 | B2 * | 4/2014 | Aliberti | H05B 45/37 362/249.02 |
| 9,768,571 | B1 * | 9/2017 | Peng | H01R 13/745 |

(Continued)

*Primary Examiner* — Phuong Chi Thi Nguyen
(74) *Attorney, Agent, or Firm* — Paul Y. Feng; One LLP

(57) ABSTRACT

An adapter for connecting an LED light fixture to the threaded, screw-in socket of an Edison lamp holder. The adapter includes lever arms that toggle between a horizontal position and an inclined position. The inclined position of the lever arms poses a small outside diameter so the adapter can be inserted into the Edison socket without catching any of the socket threads. When fully seated inside the Edison socket, the lever arms are pushed into the horizontal position. A central core translating within the shell when pushed to the top position inside the shell locks the lever arms in the horizontal position. The lever arms when locked in the horizontal position define an outsider diameter larger than the internal diameter of the Edison socket to wedge the adapter therein.

20 Claims, 12 Drawing Sheets

(56) References Cited

U.S. PATENT DOCUMENTS

| | | | |
|---|---|---|---|
| 10,340,646 | B2 | 7/2019 | Nguyen |
| 10,561,007 | B2 | 2/2020 | Winslett |

* cited by examiner

SECTION B-B

SECTION D-D

ELECTRICAL ADAPTER WITH INTEGRAL LEVER ARMS

FIELD OF THE INVENTION

The present invention relates to residential and commercial lighting fixtures. In particular, the present invention relates to mounting hardware for ceiling light fixtures or similar luminaires.

BACKGROUND OF THE INVENTION

Recessed lighting fixtures are commonplace in residential homes and commercial buildings. A recessed lighting fixture typically has a metal housing or can, an electrical junction box, and a conical-shaped recessed trim piece to direct and reflect the lighting emitted by a bulb that is in a bulb holder or socket. The recessed lighting "can" is installed above the ceiling in a building or house so that the opening in the can and trim are flush with the ceiling. The light is thus recessed into the ceiling.

The current trend is to use energy efficient LEDs in all light fixtures including recessed light fixtures. The trend includes adapting an LED trim assembly for use in a preexisting light fixture that was originally designed to accept an incandescent bulb or compact fluorescent light which have Edison base screw-in sockets.

SUMMARY OF THE INVENTION

The present invention in various exemplary embodiments is directed to a plug-in adapter for an LED light fixture that converts its electrical connection for use with an Edison lamp holder having traditional electrical conductors with internal threads. In a preferred embodiment, the adapter for use with an Edison lamp holder has a finger grip base, a central core extending from above from the base and having a top, a side electrical contact disposed on a side of the central core, a top electrical contact disposed at the top of the central core, a shell with a first outside diameter at least partially overlying the core, wherein the core translates between a top position and a bottom position within the shell. The side and top electrical contacts protrude through or are exposed to the exterior of the shell when the core is translated to the top position. At least two opposed, lever arms are hinged at a top of the shell, wherein the lever arms swing between a horizontal position and an inclined position relative to the top of the shell. The lever arms when in the horizontal position define a second outside diameter that is greater than the first outside diameter of the shell.

When the adapter is inserted into the Edison lamp holder or socket, the lever arms bottom out inside the socket and are moved to the horizontal position. Simultaneously, the central core is translated to the top position within the shell where the central core blocks the lever arms from swinging back to the inclined position. Because the second diameter of the lever arms in the horizontal position is larger than the inside diameter of the Edison socket, the lever arms are wedged therein and retain the adapter within the Edison socket. The top and side electrical contacts engage the Edison socket's internal electrical conductors completing an electrical circuit. An LED trim or light fixture when wired to the adapter becomes electrically powered when the adapter is pushed into the Edison socket.

To unplug or release the adapter from the Edison socket, the user tugs on the finger grip base to translate the central core to the bottom position within the shell. The central core once moved out of the way unblocks the lever arms movement, which are now free to swing back to the inclined position. The smaller first diameter of the inclined lever arms allows the adapter to freely pull out of the Edison socket.

The lever arms swing from the inclined position to the horizontal position and back. The lever arms optionally include a slightly resilient or flexible material such that the lever arms when rotated into the horizontal position bend slightly to exert an outward bias against the interior wall of the Edison socket to help wedge and retain the adapter inside the Edison socket.

DETAILED DESCRIPTION OF THE PREFERRED EMBODIMENTS

The present invention is directed to an Edison adapter configured to install or plug into an Edison base lamp holder or socket. The Edison base or socket is commonly found in residential and commercial lighting fixtures designed to receive, e.g., incandescent, halogen, CFL, and more recently, LED light bulbs. The most common socket is the Edison E26 base that receives standard 25-, 40-, 60-, 75- and 100-watt incandescent bulbs at 120 Volts AC. There are other Edison socket diameters and sizes known in the art, and the preferred embodiments are equally applicable to those sizes. Common LED light fixtures, LED trim assemblies, and the like have a power connection that terminates in a quick connect or like connector that is incompatible with a threaded Edison socket. The present invention adapter enables such LED light fixtures or LED trim assemblies to directly plug into the Edison lamp holder without tools or electrical knowledge for do-it-yourself lay persons.

Figure 9:
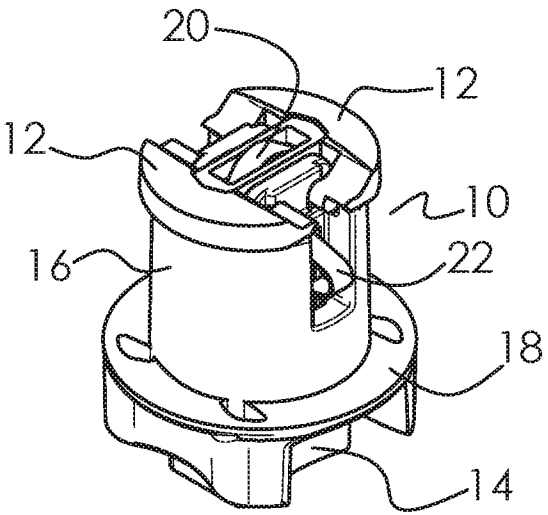
FIGS. 8 and 9 show preferred embodiment lever arms being assembled to the top of the shell.
Figure 8:
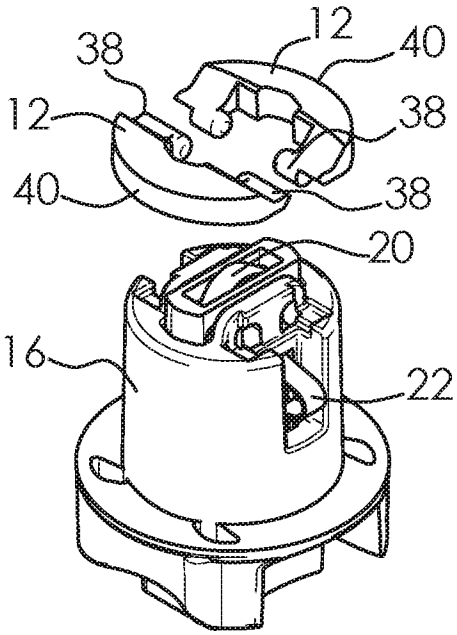

In a preferred embodiment shown in FIG. 9, the adapter assembly 10 includes a finger grip base 14, a flange 18 above it, and a cylindrical shell 16 above that. At the top are a pair of hinged lever arms 12. A top electrical contact 20 protrudes through a partial open top of the shell 16. Through opposite sides of the shell 16 protrudes one or more side electrical contacts 22. When this adapter 10 is inserted into a standard Edison socket, the top electrical contact 20 engages the base of the Edison socket while the side electrical contacts 22 engage the metal interior threads of the Edison socket. Together the electrical contacts 20, 22 complete a circuit with the Edison socket. There are preferably two electrical contacts, a top and a side 20, 22, to complete the AC circuit. The side electrical contacts 22 are interconnected so they are shorted together.

Figure 1:
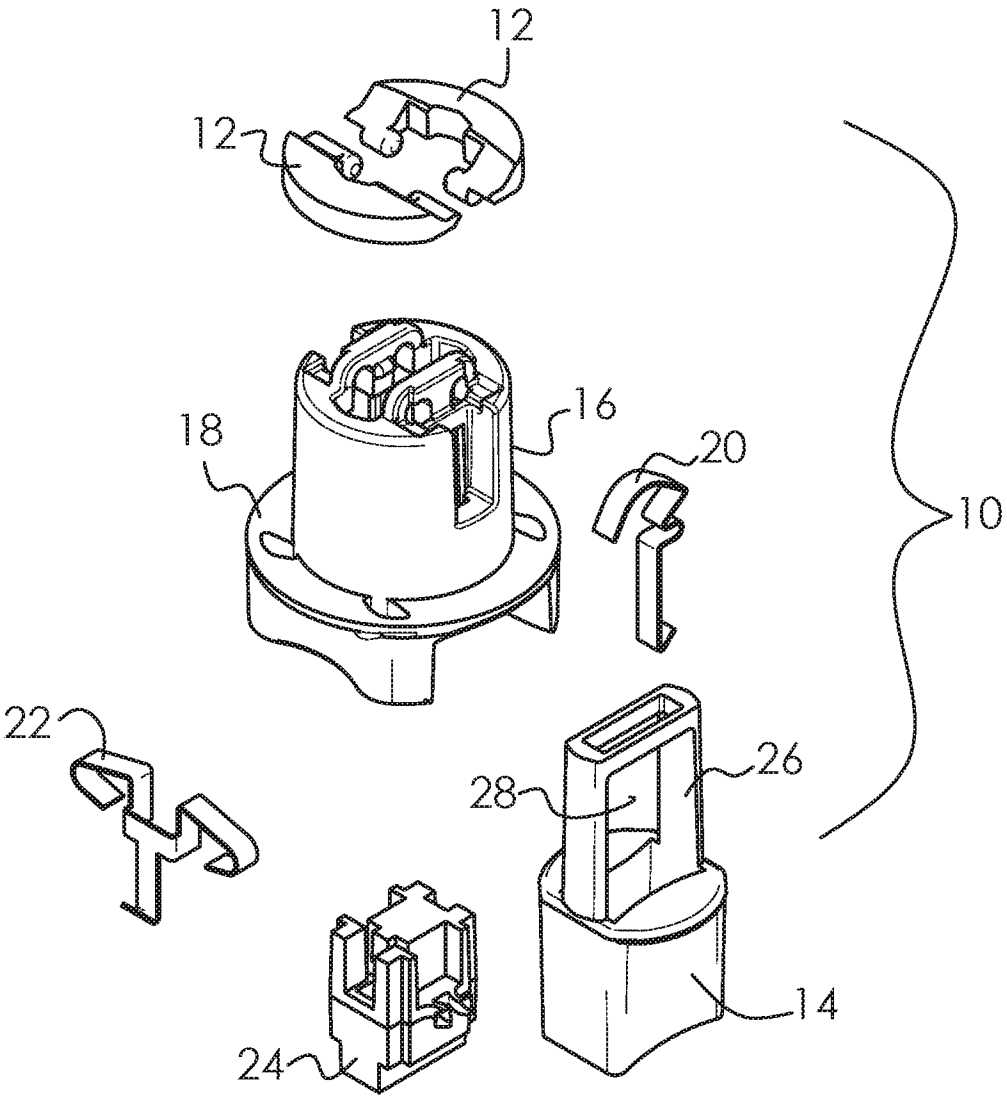
FIG. 1 is an exploded perspective view of a preferred embodiment Edison adapter.
Figure 3:
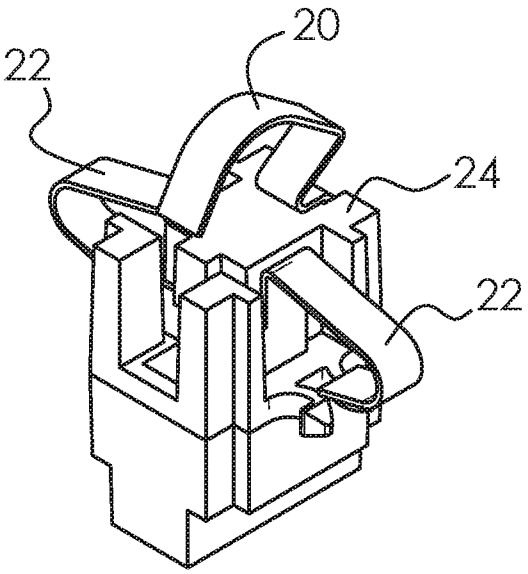
FIG. 3 is perspective view of the central core with side and top electrical contacts assembled thereto.
Figure 2:
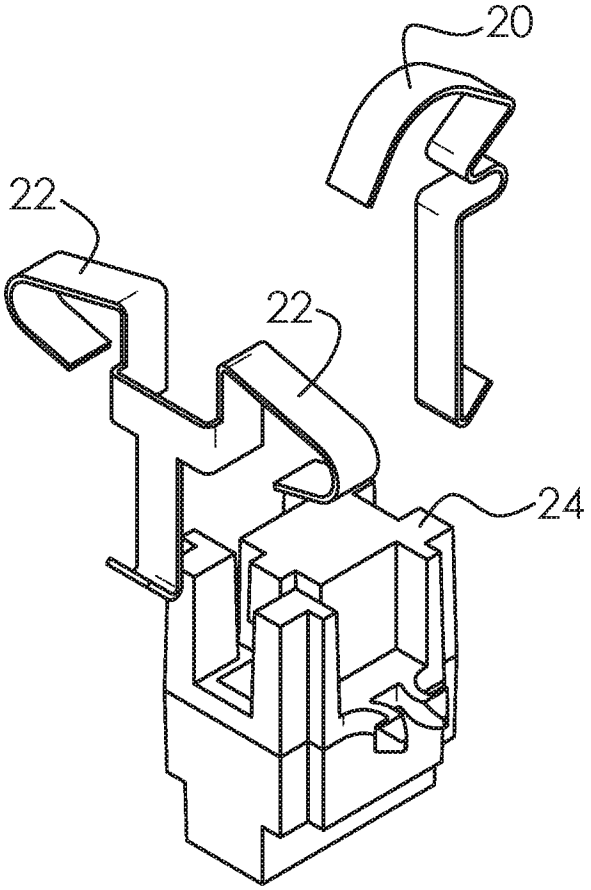
FIG. 2 is an exploded perspective view of a central core with side and top electrical contacts.
Figure 5:
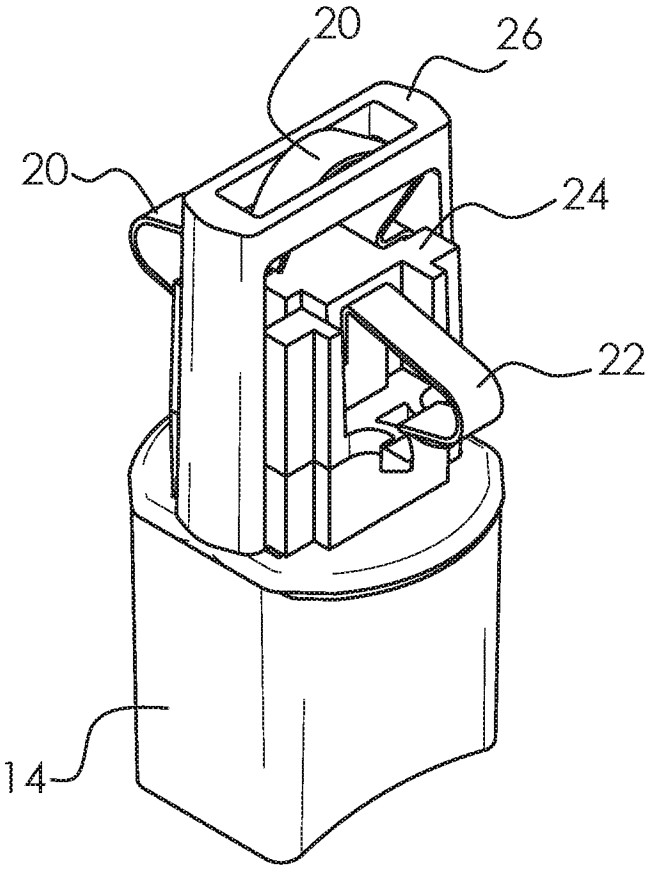
FIGS. 4 and 5 show the center core being assembled to the finger grip base.
Figure 4:
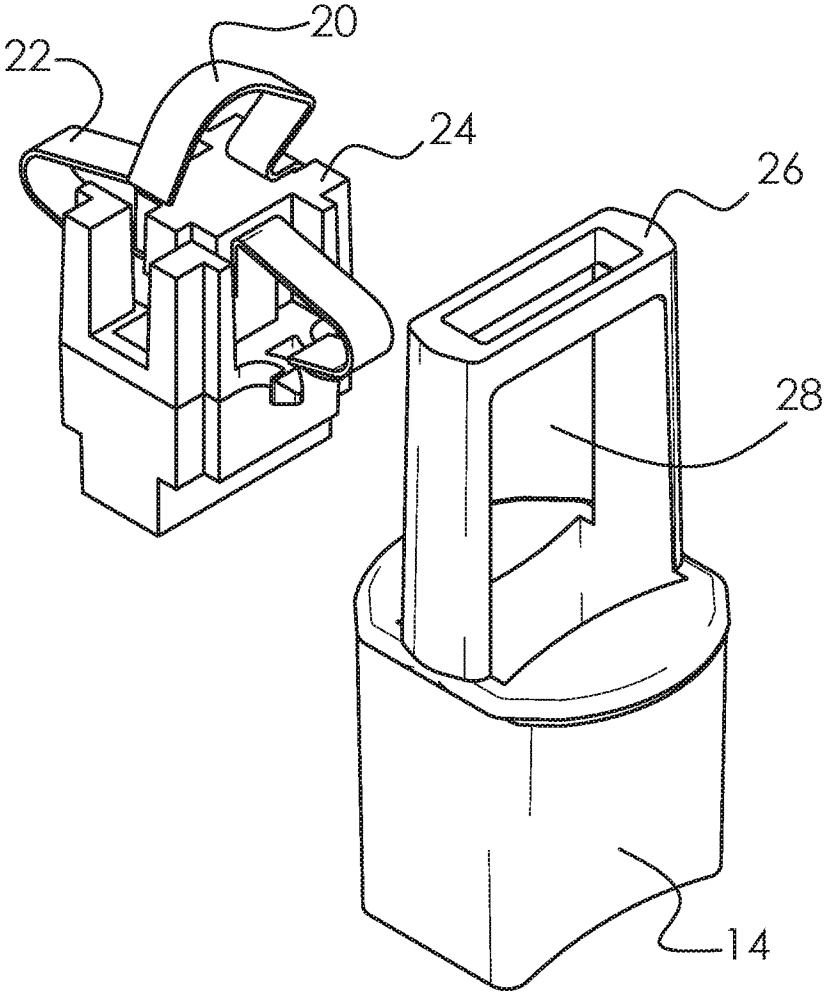

FIG. 1 provides an exploded perspective view of a preferred embodiment adapter 10. A polygonal shaped finger grip base 14 is provided. The polygonal cross-sectional shape is preferred to provide the user with a gripping surface and the angular edges allow for finger manipulation during adapter installation or removal. A rounded or oval finger grip base is also contemplated. As seen in FIGS. 1, 4, and 5, extending from just above the finger grip base 14 is a frame 26 with an opening 28 therethrough. A core 24 fits inside that opening 28 in the frame 26 as depicted in FIGS. 4, 5. As seen in FIGS. 2, 3, the core 24 supports the metal electrical contacts 20, 22.

The electrical contacts 20, 22 preferably include an angular "V" shape where the vertex protrudes outward, which vertex is intended to engage the electrically powered threaded socket of the Edison lamp holder. The contacts 20, 22 are formed from bent copper strips that have some resilience. Conductors made from other electricity conducting material are contemplated. The core 24 is preferably made from an insulator material such as plastic, fiberglass, ceramic, or the like.

Figure 7:
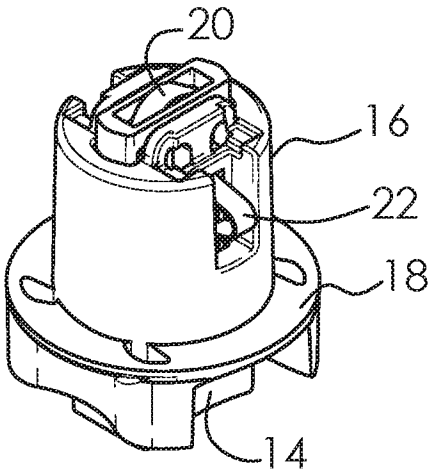
FIGS. 6 and 7 show a shell being placed over the inner core.
Figure 6:
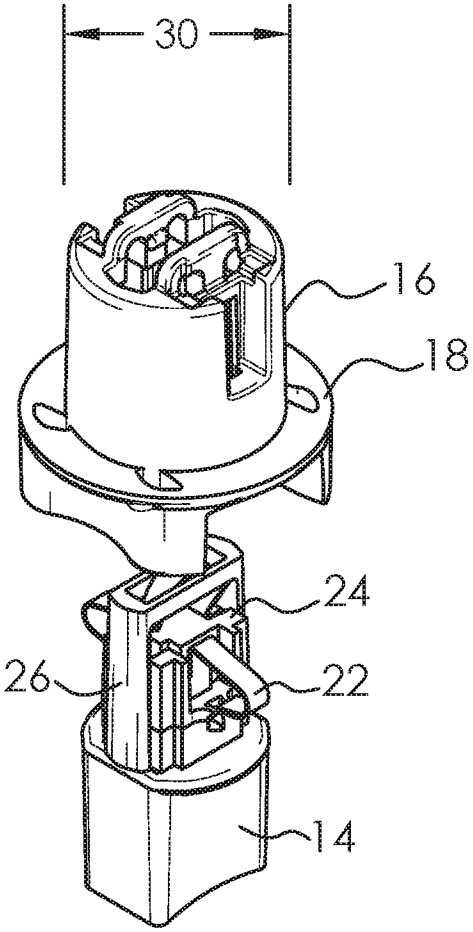

In FIGS. 6, 7, a subassembly of the core 24 with electrical contacts 20, 22 is shown being inserted through an open bottom of the hollow shell 16. The shell 16 has a preferably rounded or cylindrical shape with a hollow interior and an open bottom similar to a stovepipe hat. Other shapes are contemplated. It is preferably made from an insulator material such as plastic or ceramic or the like. The round shape of the shell 16 is intended to fit within the threaded Edison socket. The shell 16 has an outside diameter 30 (FIGS. 6, 11) that is smaller than the standard Edison threaded socket inside diameter so the shell 16 passes straight into the Edison socket without interference from the threads. The optional flange 18, also made from an insulator material, is provided to separate the user's fingers beneath the flange from the electrical power above the flange. The flange 18 has an outside diameter preferably larger than the Edison socket to function as a stop to prevent inadvertent over-insertion of the adapter into the Edison socket. The flange 18 also protects the user from inadvertently touching any electrically powered component.

Figure 11:
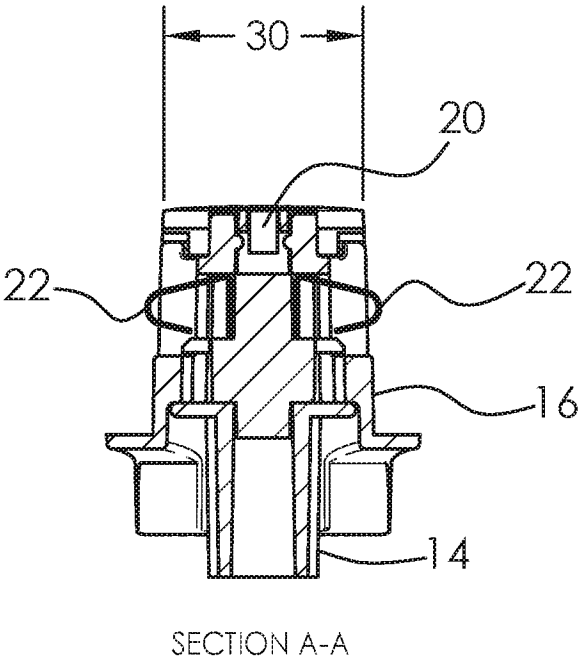
FIG. 11 is a cross-sectional view of the adapter taken along line A-A of FIG. 10.
Figure 10:
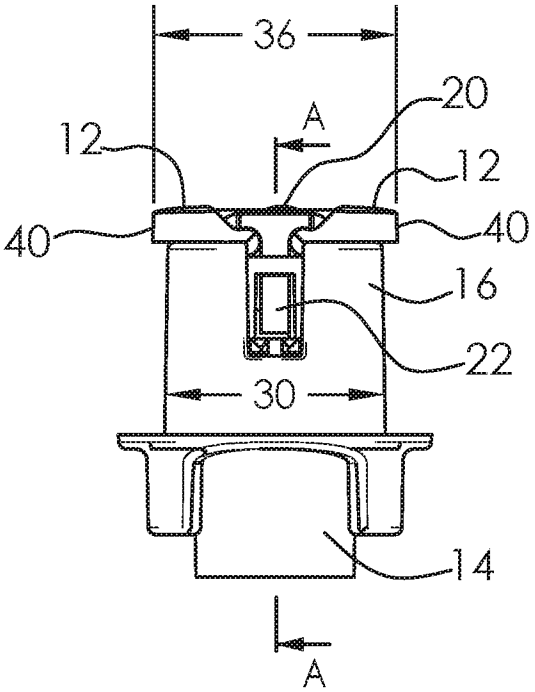
FIG. 10 is a side elevational view of the adapter.

As best seen in FIGS. 7, 10, and 11, the side and top electrical contacts 22, 20, respectively, protrude through openings in the shell 16. If fact, the electrical contacts 20, 22 preferably extend beyond the exterior surface of the shell 16 to ensure physical engagement with the interior of the Edison lamp holder to complete an electrical circuit. As mentioned earlier, the electrical contacts 20, 22 are preferably made from bent copper or like metal conductor. As the adapter 10 is pushed into an Edison socket 32 (FIGS. 18, 19, 20), in a preferred embodiment, the bent copper conductor has some resilience so that the exposed vertex extending through the shell openings engage the internal Edison socket threads 34 and slightly flexes as it slides or snaps over each crest of each thread and lands in a thread root. This outward bias in the electrical contacts 20, 22 engaging the Edison socket threads helps retain the adapter 10 inside the Edison lamp holder and opposes gravity to prevent unintended disengagement of the adapter from the Edison lamp holder.

FIGS. 8-11 depict a pair of hinged lever arms 12 mounted to the top of the shell 16. The preferred embodiment adapter has two opposed lever arms 12 that are hinged to the shell 16 at about the center of the shell. In alternative embodiments, there may only be one hinged lever arm or more than two hinged lever arms. The preferred embodiment lever arm 12 shown in FIG. 8 has a crescent of "C" shape with hinges 38 that receive pivot points formed at the top of the shell 16. Each crescent lever arm 12 has a distal tip or extension 40. The lever arms 12 have hinges 38 so that they can swing between a horizontal position and an inclined position to achieve a toggling effect when swinging between the two positions.

Figure 13:
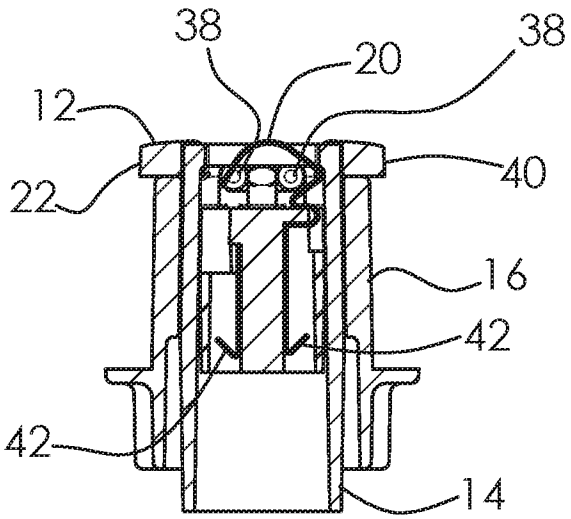
FIG. 13 is a cross-sectional view of the adapter taken along line B-B of FIG. 12.
Figure 12:
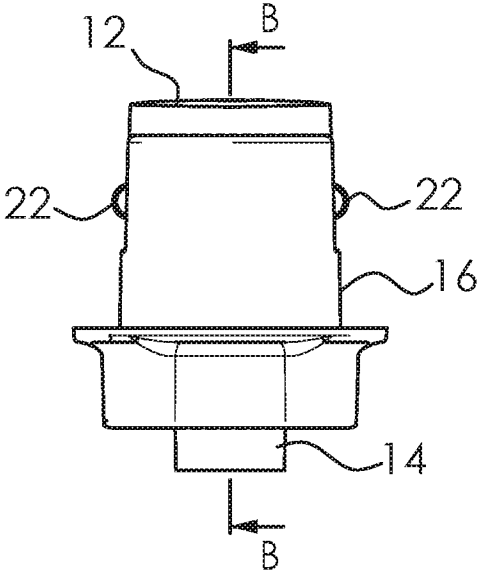
FIG. 12 is a side elevational view of the adapter from FIG. 10 rotated 90 degrees.
Figure 15:
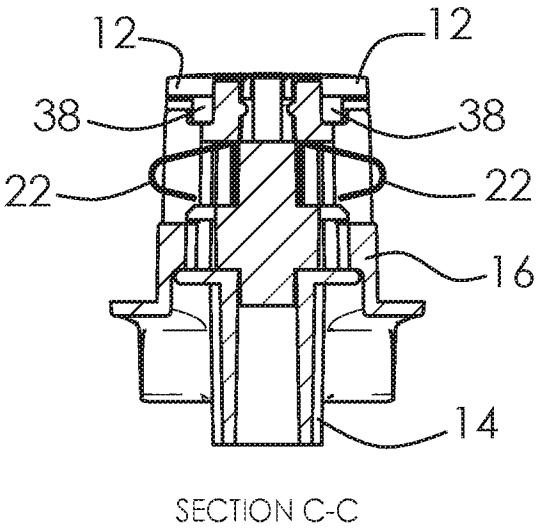
FIG. 15 is a cross-sectional view of the adapter taken along line C-C of FIG. 14.
Figure 14:
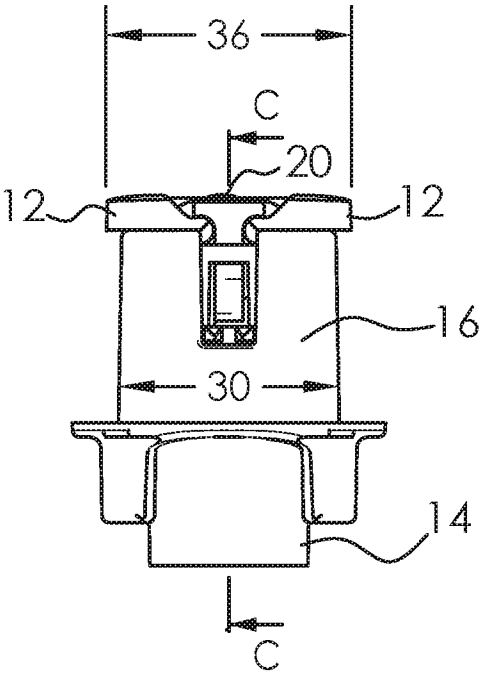
FIG. 14 is a side elevational view of the adapter from FIG. 12 rotated 90 degree.

FIGS. 10-15 show the lever arms 12 in the horizontal position generally flush with the top of the shell 16. As best seen in FIGS. 10 and 14, when the lever arms 12 are situated in the horizontal position, they define an outside diameter 36 that is preferably greater than the outside diameter 30 of the shell 16. In other words, at least one or both lever arms 12 when in the horizontal position have their distal tips 40 extending beyond the exterior surface of the shell 16. This larger OD 36 helps wedge the lever arms 12 inside the Edison socket when toggled to the horizontal position.

Figure 17:
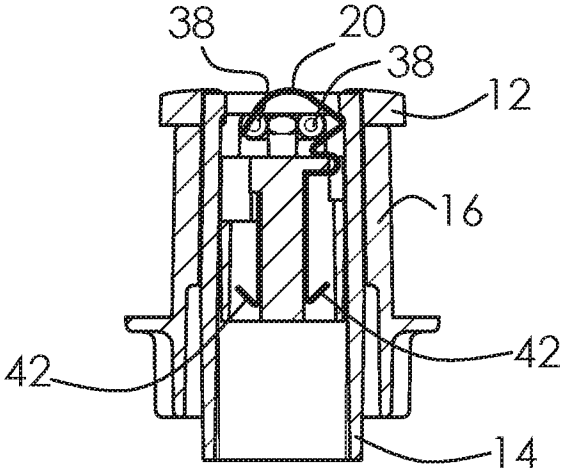
FIG. 17 is a cross-sectional view of the adapter taken along line D-D of FIG. 16.
Figure 16:
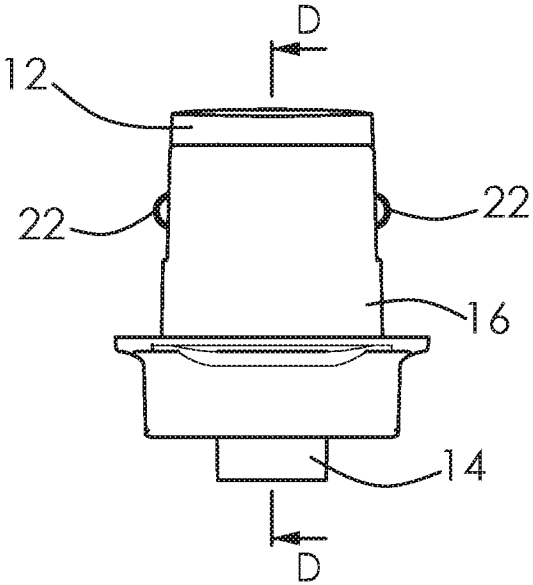
FIG. 16 is a side elevational view of the adapter from FIG. 14 rotated 90 degrees.

FIGS. 10, 12, 14, and 16 provide side elevational views of the preferred embodiment adapter 10, each rotated 90 degrees from the prior view, along its central axis. FIGS. 11, 13, 15, and 17 provide the respective cross-sectional views of FIGS. 10, 12, 14, and 16. FIG. 17 shows a hollow finger grip base 14. The hollow interior provides space for electrical wiring passing therethrough that connect the electrical terminals 42, that are part of the electrical contacts 20, 22 of the adapter 10, with the LED light fixture or trim assembly (not shown).

Figure 19:
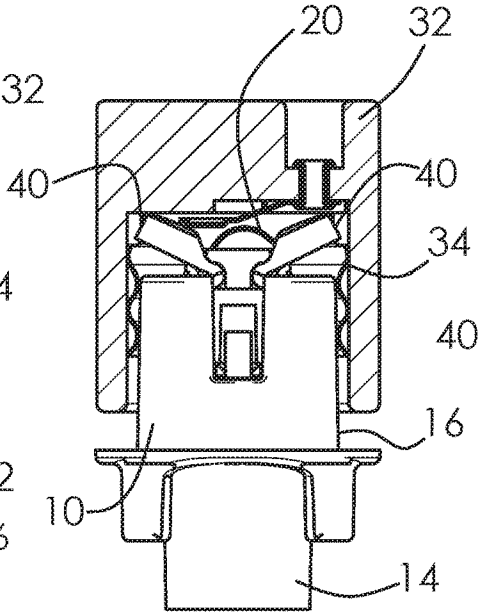
Figure 18:
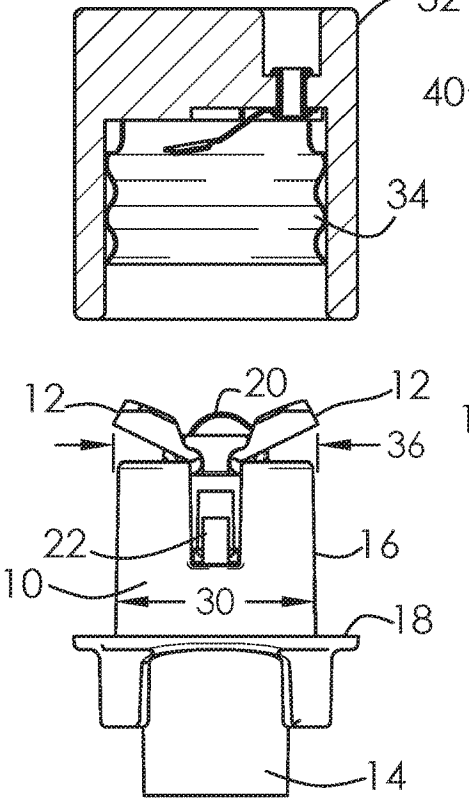
Figure 25:
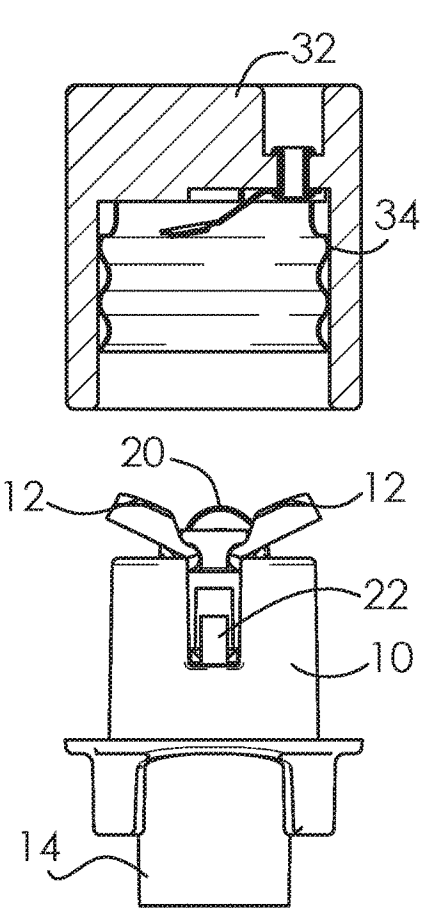
FIGS. 22-25 depict, in cross-section, the process of disengaging the adapter from the Edison lamp holder.

FIGS. 18-21 show the push-in installation process for the adapter 10 into the Edison lamp holder 32. FIGS. 18-19 show the lever arms 12 in the inclined position. In the preferred embodiment, the lever arms 12 may be moved to their inclined position by the user where the lever arms stay in that position based on slight friction at the hinges 38. In an alternative embodiment, the lever arms 12 may be biased into this inclined position using a small torsion or bar spring.

The adapter 10 in FIG. 18 is ready for installation into the Edison lamp holder 32, shown in a cross-section. The lever arms 12 when situated in the inclined position has an outside diameter (OD) 36 that is less than or equal to the outside diameter (OD) 30 of the shell 16. These OD's 36, 30 are preferred so as the adapter 10 is pushed into the Edison lamp holder 32 (FIG. 19) that the lever arms 12 do not inadvertently engage the internal threads 34 of the Edison lamp holder.

Figure 20:
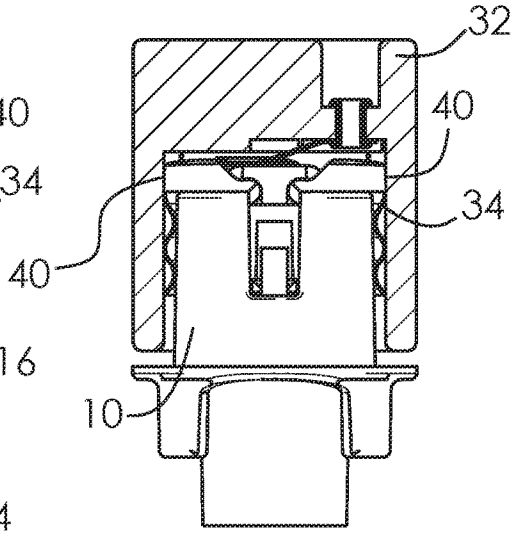

As seen in FIGS. 19-20, the user pinches the finger grip base 14, then pushes the adapter 10 into the Edison lamp holder 32 until the adapter has hit bottom, and the lever arms 12 have toggled into the horizontal position to lock against the interior wall 34 of the Edison lamp holder 32. Some friction via interference fit in the hinges 38 of the lever arms 12 inhibit the lever arms 12 from inadvertently toggling back to their inclined position, which would otherwise cause disengagement of the adapter 10. Further, in FIG. 20, the distal tips 40 of the lever arms 36 are wedged into the compact space inside the Edison socket 32 to lock the structures in place. To increase the friction in the hinge, the hinge may include more textured surfaces that rub against each other when swiveling. Or the hinge may include a bump or detent so that the lever arm is urged to either side of the detent into either the horizontal or inclined positions.

Figure 21:
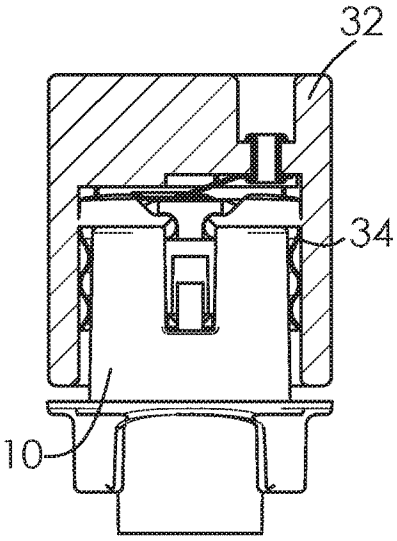
FIGS. 18-21 depict, in cross-section, the process of inserting the adapter into an Edison lamp holder.

In a preferred embodiment, there may be some flex or resilience in the material (e.g., plastic) of the lever arms 12 such that they slightly bend when engaging the interior socket wall of the Edison lamp holder 32 and exert some outward bias. This outward bias against the wall further helps wedge the adaptor 10 inside the Edison lamp holder 32 so the adapter does not unexpectedly disengage. In FIG. 20, the adapter 10 is fully seated inside the Edison lamp holder 32. All electrical contacts 20, 22 are engaging the internal threads/electrical conductors 34 of the Edison lamp holder 32 to complete a circuit. FIG. 21 shows the adapter 10 locked inside the Edison lamp holder 32.

The adapter 10 has internal electrical terminals 42, shown in FIG. 13, that are wired to the LED light fixture or trim assembly (not shown). So when the adapter 10 is wired to the LED light fixture or trim assembly, it is a simple step of pushing the adapter 10 into an existing Edison lamp holder 32 to power up that fixture. In this manner, many current LED fixtures are easily adapted for use with all existing screw-in Edison lamp holders or the like.

Figure 24:
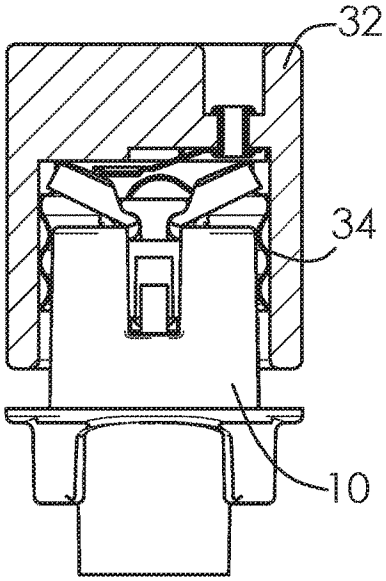
Figure 23:
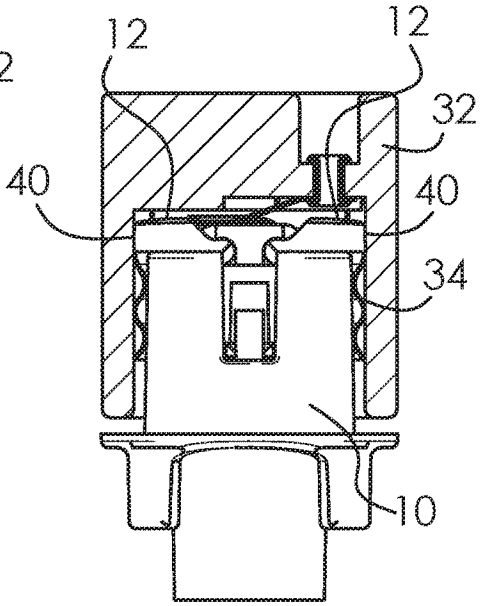

FIGS. 22-25 shows the process of disengaging the adapter 10 from the Edison lamp holder 32. To disengage, the user simply tugs on the finger grip base 14 to pull the adapter out of the Edison socket, as in FIG. 25. The tugging force overcomes the hinge friction and/or outward bias of the lever arms 12 exerted against the interior wall 34 to cause the lever arms to unwedge themselves and toggle back to their inclined position, as seen in FIGS. 23, 24. This releases the adapter 10 from inside the Edison socket 32.

Figure 22:
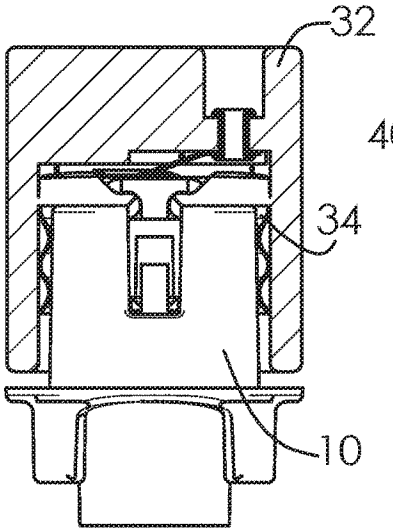
Figure 27:
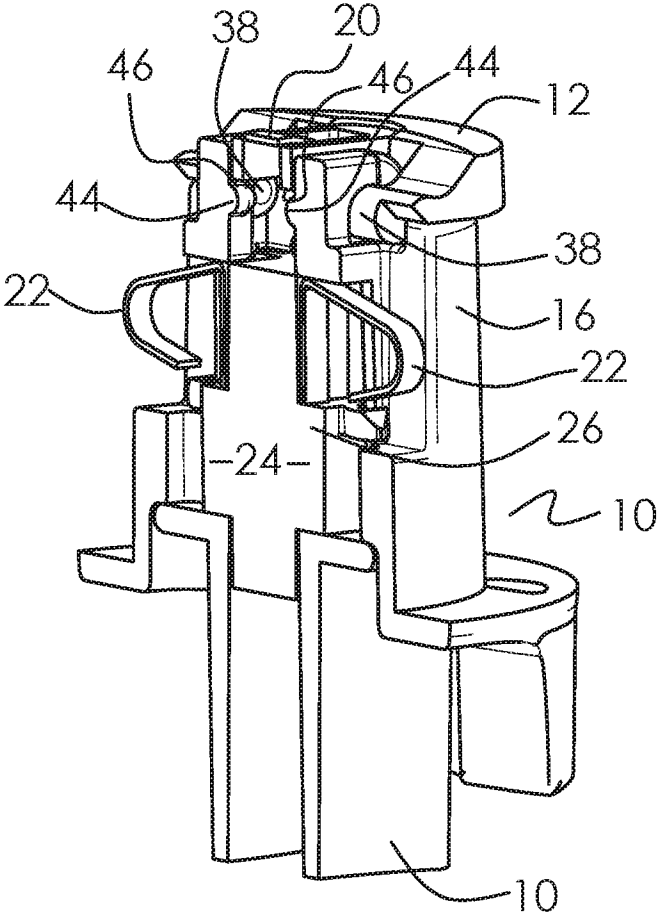
FIG. 27 is a cutaway perspective view of the adapter of FIG. 26 rotated 90 degrees along its central axis.
Figure 26:
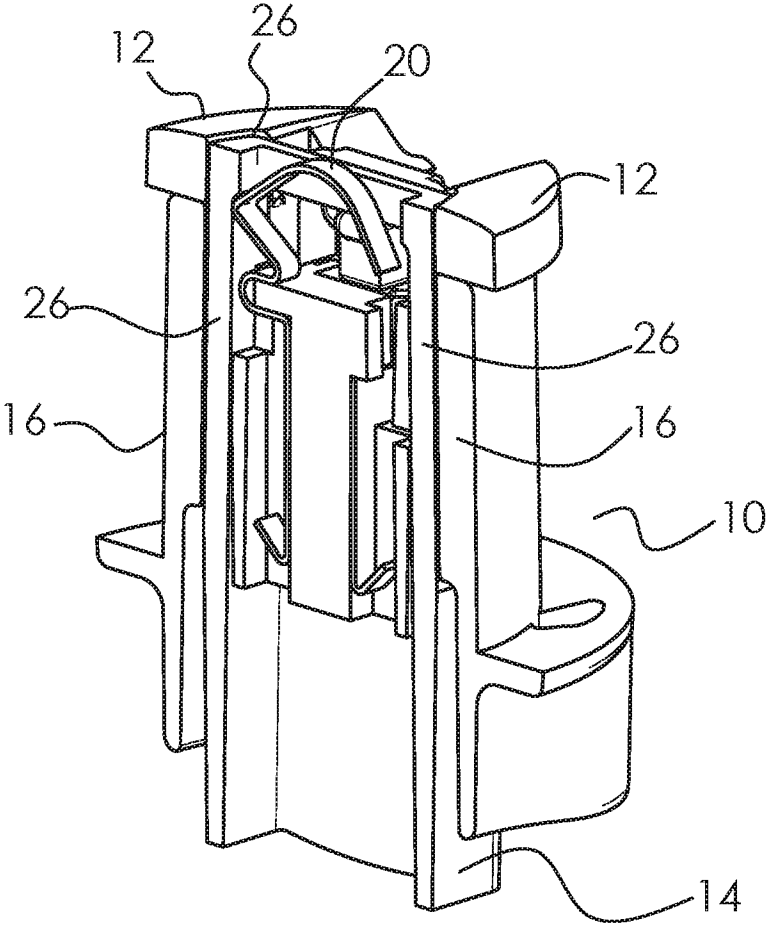
FIG. 26 is a cutaway perspective view of an adapter including a slide lock.

FIG. 26 is a perspective, cutaway view of the adapter 10, similar to FIG. 13, showing an optional slide lock feature to hold the adaptor 10 in the engaged position such as shown in FIGS. 21, 22. FIG. 27 is another perspective cutaway view of the adapter 10 with slide lock feature rotated 90 degrees along its central axis from what is shown in FIG. 26.

The slide lock feature in a preferred embodiment contemplates a translating or sliding frame 26 and core 24 that moves up and down relative to the shell 16. The core 24 preferable carries top electrical contact 20, here the conductor for the hot side of the mains power supply. When the frame 26 and core 24 are pushed via finger grip base 14 upward into the position shown in FIG. 26 with the central core 24 fully inserted inside the shell 30, the lever arms 12 on top are blocked from swiveling on their axis back into their inclined position, which would otherwise allow gravity to separate the adapter 10 from the Edison lamp holder 32. The adapter 10 is thus locked into position. Tugging on the finger grip base 14 translates the frame 26 and central core 24 assembly downward relative to the shell 16 to vacate an open space adjacent the lever hinges 38 and they are now able to move freely again. The lever arms 12 are now free to swivel into the inclined position so the entire adapter 10 can be withdrawn from the Edison lamp holder 32.

FIG. 27 shows the adapter 10 rotated 90 degrees from that shown in FIG. 26, and it provides a better view of the slide lock action. The adapter 10 has two positions, locked and unlocked. In the unlocked position, when inserted into the Edison lamp holder 32, the lever arms 12 have no movement restrictions and freely swivel subject to minor friction at the hinge. They are manually positioned facing slightly upward (inclined position) to insert into the lamp holder. As the adapter 10 is inserted into the lamp holder, the neutral contacts (side electrical contact 22) on the side engage the Edison socket threads 34 electrically. As the translating or sliding central core 24 and frame 26 are pushed into the locking position, the top electrical contact 20 for the "hot" wire is pushed deeper into the lamp holder and completes the electrical circuit.

In a preferred embodiment, the central core 24 and frame 26 assembly slide past an optional set of bosses 44 and complementary detents/cutouts 46, as seen in FIG. 27. The bosses 44 are formed as part of and extends from the shell 16. The frame 26 (or alternatively the central core 24) includes a mating detent 46 which deforms as it passes over the boss 44. The boss 44 then "snaps" into the cavity of the detent 46, locking the frame/core assembly 26, 24 to the shell 16, and also locking and immobilizing the lever arms 12 in their horizontal position. No parts are deformed in this position. The load/weight of the frame/core center assembly and the contact contained within are resting on and above the bosses 44. The lever arms 12 are blocked at this point from moving about their axes. The only way for them to move is to pull the frame/core center assembly 26, 24 down past the bosses 44. The boss-to-detent contact disengages, and the electrical circuit is broken when the "hot" top electrical contact 20 disengages from the lamp holder socket base. Also, the lever arms 12 can rotate. This unlocking action allows the entire adapter 10 to be released from the Edison lamp holder 32. The aforementioned means for locking contemplate at least one or more complementary combinations of a groove, a boss, a detent, a notch, a block, a bump, a hole, or the like. One or more of the locking means and their complementary structures can be disposed on either the shell or the core and frame assembly.

During installation of the adapter 10 into the Edison lamp holder 32, the two copper side (ground/neutral) electrical contacts 22 shown sticking out from the side of the shell 16 make electrical contact before the "hot" top contact 20 makes connection to the circuit. This ensures that the ground/neutral is engaged prior to closing the circuit. The present adapter 10 therefore benefits from a safer electrical design. A hot and neutral set of wire leads may be attached to this adapter 10 for connection to any LED trim or light fixture.

Finally, when the frame/core center assembly 26, 24 is locked and the lever arms 12 are likewise locked in the horizontal position, the adapter 10 can suspend a light fixture of up to about five (5) pounds in weight securely via only the electrical wiring connected to the light fixture. This is advantageous during installation, because the user can push the adapter into the Edison socket with one hand while holding up the light fixture with the other hand, all the while standing on top of a ladder. The adapter is able to suspend the plugged-in light fixture by itself, thus freeing both hands of the user to install the light fixture to the ceiling. The straight push-in feature of the adapter is further advantageous and easier for the user, because it avoids having to be screwed into the Edison socket threads.

In the various applications, the present invention is preferably designed to be used with 120 VAC and LED lighting fixture trims. The electrical and mechanical design considerations preferably centered around high voltage operation and locking the adapter into a threaded socket. Furthermore, the preferred embodiments and their components disclosed herein are intended to be mix-and-matched, and modified with each other.

While particular forms of the invention have been illustrated and described, it will be apparent that various modifications can be made without departing from the spirit and scope of the invention. It is contemplated that components from one embodiment may be combined with components from another embodiment.

What is claimed is:

1. An adapter for use with an Edison lamp holder having electrical conductors and threads therein, comprising:

a finger grip base;

a central core disposed on the base;

a side electrical contact disposed on a side of the central core;

a top electrical contact disposed at a top of the central core;

a shell with a top and a first outside diameter at least partially overlying the core, wherein the core translates between a top position and a bottom position within the shell, and the side and top electrical contacts protrude through to the exterior of the shell when the core is translated to the top position;

at least two opposed, lever arms hinged to a top of the shell toward a center thereof and include a toggle action swinging between a horizontal position and an inclined position, wherein the lever arms when in the horizontal position define a second outside diameter that is greater than the first outside diameter of the shell;

wherein when the lever arms are toggled to the horizontal position and the central core is translated to the top position within the shell, the central core blocks the lever arms from swinging back to the inclined position to help retain the adapter within the Edison lamp holder, and the top and side electrical contacts engage the Edison lamp holder electrical conductors completing an electrical circuit; and wherein when the central core is translated to the bottom position within the shell, the blocked lever arms are free to swing back to the inclined position.

2. The adapter of claim 1, wherein the shell includes a flange overlying the finger grip base.

3. The adapter of claim 1, wherein the adapter includes two side electrical contacts electrically connected and disposed in diametrically opposed positions on the central core and respectively protrude through the exterior of the shell.

4. The adapter of claim 1, wherein the central core and shell have respective and complementary boss and detent that block the central core movement relative to the shell.

5. The adapter of claim 1, wherein the central core and shell include complementary locking means for blocking movement of the central core relative to the shell.

6. The adapter of claim 1, wherein the lever arms when disposed in the inclined position define a third outside diameter that is equal to or smaller than the first outside diameter of the shell.

7. The adapter of claim 1, wherein the lever arm hinges include friction to retain the lever arms in an inclined position.

8. The adapter of claim 1, wherein the side electrical contact protrudes sufficiently through the exterior of the shell to make electrical connection with electrical conductor of the Edison lamp holder.

9. The adapter of claim 1, wherein top and side electrical contacts include an electrical conductor material.

10. An adapter for use with an Edison lamp holder, comprising:

a finger grip base;

a central core extending above from the base and having a top;

a side electrical contact disposed on a side of the central core;

a top electrical contact disposed at the top of the central core;

a shell with a first outside diameter at least partially overlying the core, wherein the core translates between a top position and a bottom position within the shell, and the side and top electrical contacts protrude through to the exterior of the shell when the core is translated to the top position;

at least two opposed, lever arms hinged at a top of the shell, wherein the lever arms swing between a horizontal position and an inclined position relative to the top, and the lever arms when in the horizontal position have a second outside diameter that is greater than the first outside diameter of the shell;

wherein when the lever arms are moved to the horizontal position and the central core is translated to the top position within the shell, the central core engages and blocks the lever arms from swinging back to the inclined position to help retain the adapter within the Edison lamp holder, and the top and side electrical contacts engage the Edison lamp holder electrical conductors completing an electrical circuit; and wherein when the central core is translated to the bottom position within the shell, the blocked lever arms are free to swing back to the inclined position.

11. The adapter of claim 10, wherein the central core and shell include complementary locking means for blocking movement of the central core relative to the shell.

12. The adapter of claim 10, wherein the adapter includes two side electrical contacts electrically connected and disposed in diametrically opposed positions on the central core and respectively protrude through the exterior of the shell.

13. The adapter of claim 10, wherein the central core and shell have cylindrical shapes and the finger grip base has a polygonal cross-section.

14. The adapter of claim 10, wherein the lever arms when disposed in the inclined position define a third outside diameter that is equal to or smaller than the first outside diameter of the shell.

15. The adapter of claim 10, wherein the side electrical contact protrudes sufficiently through the exterior of the shell to make electrical connection with electrical conductor of the Edison lamp holder.

16. An adapter for use with an Edison lamp holder having electrical conductors and threads therein, comprising:

a finger grip base;

a central core extending above from the base and having a top;

at least one side electrical contact disposed on a side of the central core;

a top electrical contact disposed at the top of the central core;

a shell with a first outside diameter at least partially overlying the core, wherein the core translates between a top position and a bottom position within the shell, and the side and top electrical contacts are exposed through to the exterior of the shell when the core is translated to the top position;

lever arms hinged at a top of the shell, wherein the lever arms swing between a horizontal position defining a larger outside diameter and an inclined position defining a smaller outside diameter;

means for locking disposed at the top of the shell, wherein when the lever arms swing to the horizontal position and the central core is translated to the top position within the shell, the central core engages the means for locking to hold the lever arms in the horizontal position with the lever arms wedged inside the Edison lamp holder and the top and side electrical contacts touch the Edison lamp holder electrical conductors completing an electrical circuit.

17. The adapter of claim 16, wherein the means for locking includes at least one of a boss, a detent, a notch, a block, a bump, a groove, and a hole.

18. The adapter of claim 16, wherein the top electrical contact is an electrically hot terminal, and the adapter includes two side electrical contacts corresponding to an electrical ground terminal and an electrical neutral terminal.

19. The adapter of claim 16, wherein the lever arms when in the horizontal position defines the larger diameter that is greater than an inside diameter of the Edison lamp holder.

20. The adapter of claim 16, wherein the locking means for holding the lever arms in the horizontal position and retains the core at the top position within the shell to resist up to about 5 pounds of downward force.

* * * * *